US011643766B2

(12) United States Patent
Ueda et al.

(10) Patent No.: US 11,643,766 B2
(45) **Date of Patent: *May 9, 2023**

(54) SEWING MACHINE

(71) Applicant: BROTHER KOGYO KABUSHIKI KAISHA, Nagoya (JP)

(72) Inventors: Daisuke Ueda, Seto (JP); Nobuhiko Funato, Gifu (JP); Fumihiro Nonobe, Inuyama (JP); Yuki Taguchi, Chita-gun (JP); Junya Kito, Nagoya (JP); Koji Funaki, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/529,982

(22) Filed: Nov. 18, 2021

(65) Prior Publication Data

US 2022/0119999 A1 Apr. 21, 2022

Related U.S. Application Data

(63) Continuation of application No. 16/576,964, filed on Sep. 20, 2019, now Pat. No. 11,214,904, which is a (Continued)

(30) Foreign Application Priority Data

Mar. 29, 2017 (JP) ..... JP2017-065880

(51) Int. Cl.
*D05B 73/12* (2006.01)
*D05B 27/24* (2006.01)

(52) U.S. Cl.
CPC ..... *D05B 73/12* (2013.01); *D05B 27/24* (2013.01)

(58) Field of Classification Search
CPC ..... D05B 73/12; D05B 27/24
See application file for complete search history.

(56) References Cited

U.S. PATENT DOCUMENTS 4,493,280 A 1/1985 Bianchi
4,646,665 A 3/1987 Jimenez et al.
(Continued)

FOREIGN PATENT DOCUMENTS

JP H09-056962 A 3/1997
JP 2007-130141 A 5/2007
(Continued)

OTHER PUBLICATIONS

Oct. 24, 2017 International Search Report issued in International Patent Application No. PCT/JP2017/030299.
(Continued)

*Primary Examiner* — Nathan E Durham
(74) *Attorney, Agent, or Firm* — Oliff PLC

(57) ABSTRACT

A sewing machine includes a needle plate, a bed portion, a first urging member, a first engagement member, a second engagement member, and a lock release mechanism. The bed portion is configured to support the needle plate. The first urging member is provided inside the bed portion and configured to urge the needle plate upward. The first engagement member is provided on the needle plate. The second engagement member is provided inside the bed portion, and is configured to fix the needle plate in a fixed position by being engaged with the first engagement member of the needle plate pressed downward against an urging force of the first urging member. The lock release mechanism is configured to release the engagement of the first engagement member and the second engagement member.

13 Claims, 14 Drawing Sheets

Related U.S. Application Data continuation of application No. PCT/JP2017/030299, filed on Aug. 24, 2017.

(56) References Cited

U.S. PATENT DOCUMENTS

| | | | |
|---|---|---|---|
| 2007/0227419 | A1 | 10/2007 | Hirose |
| 2010/0175601 | A1 | 7/2010 | Fukao |
| 2010/0212563 | A1 | 8/2010 | Mizuno |
| 2011/0297063 | A1 | 12/2011 | Fukao |
| 2016/0040342 | A1 | 2/2016 | Maeda et al. |

FOREIGN PATENT DOCUMENTS

| | | | |
|---|---|---|---|
| JP | 2007-244721 | A | 9/2007 |
| JP | 2010-158458 | A | 7/2010 |
| JP | 2011-251083 | A | 12/2011 |
| JP | 2013-048846 | A | 3/2013 |
| JP | 2016-036570 | A | 3/2016 |

OTHER PUBLICATIONS

May 12, 2021 U.S. Office Action issued U.S. Appl. No. 16/576,964.
Aug. 25, 2021 Notice of Allowance Issued in U.S. Appl. No. 16/576,964.

SEWING MACHINE

RELATED AND PRIORITY APPLICATIONS

This application is a continuation application of U.S. patent application Ser. No. 16/576,964, filed Sep. 20, 2019, which is a continuation application of International Application No. PCT/JP2017/030299, filed Aug. 24, 2017, which claims priority from Japanese Patent Application No. 2017-065880, filed on Mar. 29, 2017. The disclosures of each of the foregoing applications are hereby incorporated by reference in their entireties.

BACKGROUND

The present disclosure relates to a sewing machine.

A sewing machine from which a needle plate is detachable is known. The known sewing machine is provided with a needle plate adjustment mechanism configured to perform position adjustment of the needle plate mounted on a bed portion. The needle plate adjustment mechanism has a first adjustment portion provided on one end portion of the needle plate, a second adjustment portion provided on another end portion of the needle plate, and a fixing portion provided on an end portion other than the two end portions of the needle plate. The needle plate is fixed to the bed portion by the fixing portion, after the position adjustment is performed by the first adjustment portion and the second adjustment portion and the needle plate is provisionally fixed.

SUMMARY

In the known sewing machine, the needle plate is fixed to the bed portion using screws, and an operation to remove the screws is troublesome.

Various embodiments of the broad principles derived herein provide a sewing machine in which a needle plate can be removed from a bed portion by a simple operation.

Embodiments provide a sewing machine that includes a needle plate, a bed portion, a first urging member, a first engagement member, a second engagement member, and a lock release mechanism. The bed portion is configured to support the needle plate. The first urging member is provided inside the bed portion and configured to urge the needle plate upward. The first engagement member is provided on the needle plate. The second engagement member is provided inside the bed portion, and is configured to fix the needle plate in a fixed position by being engaged with the first engagement member of the needle plate pressed downward against an urging force of the first urging member. The lock release mechanism is configured to release the engagement of the first engagement member and the second engagement member.

BRIEF DESCRIPTION OF THE DRAWINGS

Embodiments will be described below in detail with reference to the accompanying drawings in which.

DETAILED DESCRIPTION

Figure 1:
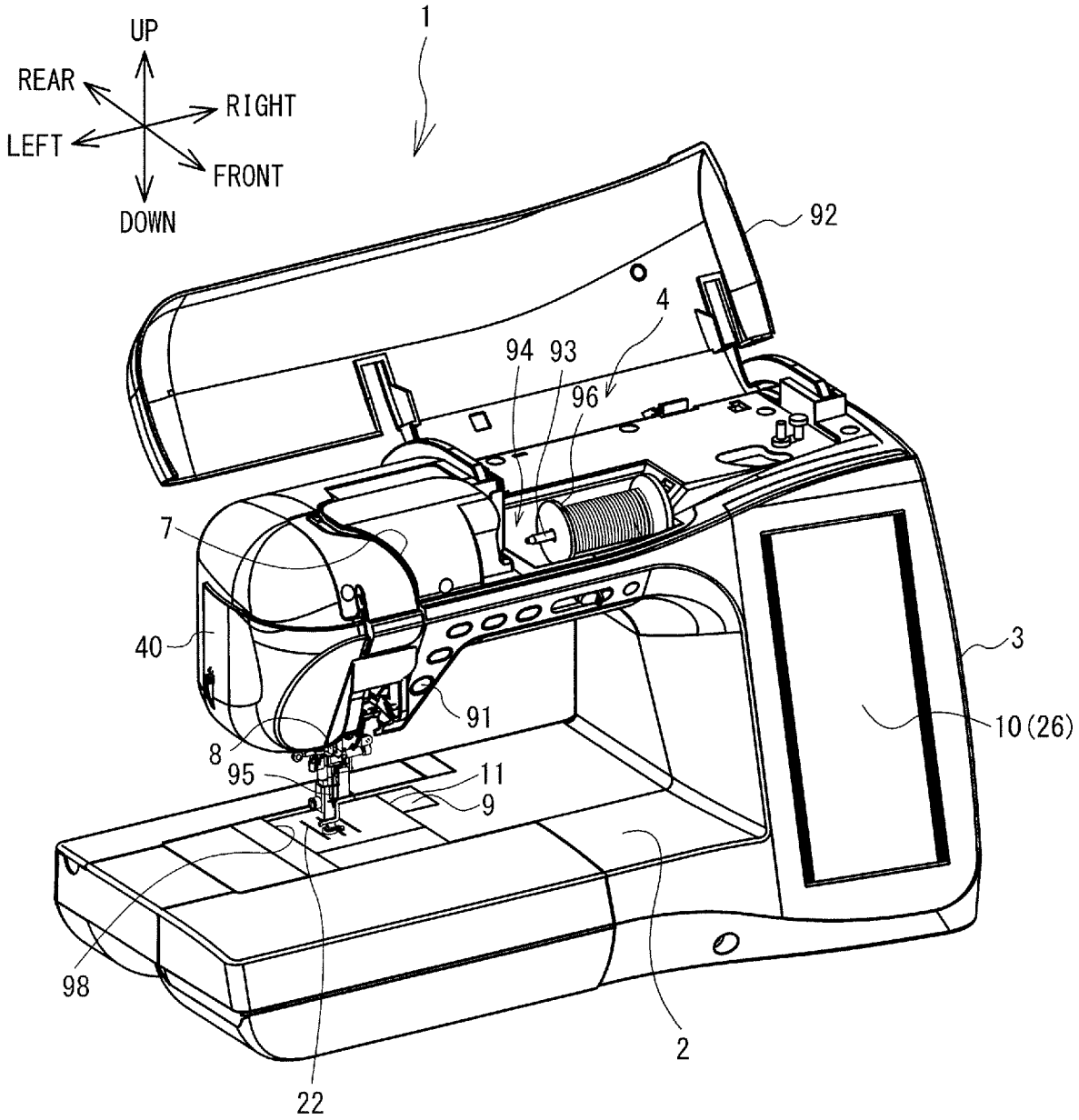
FIG. 1 is a perspective view of a sewing machine.
Figure 2:
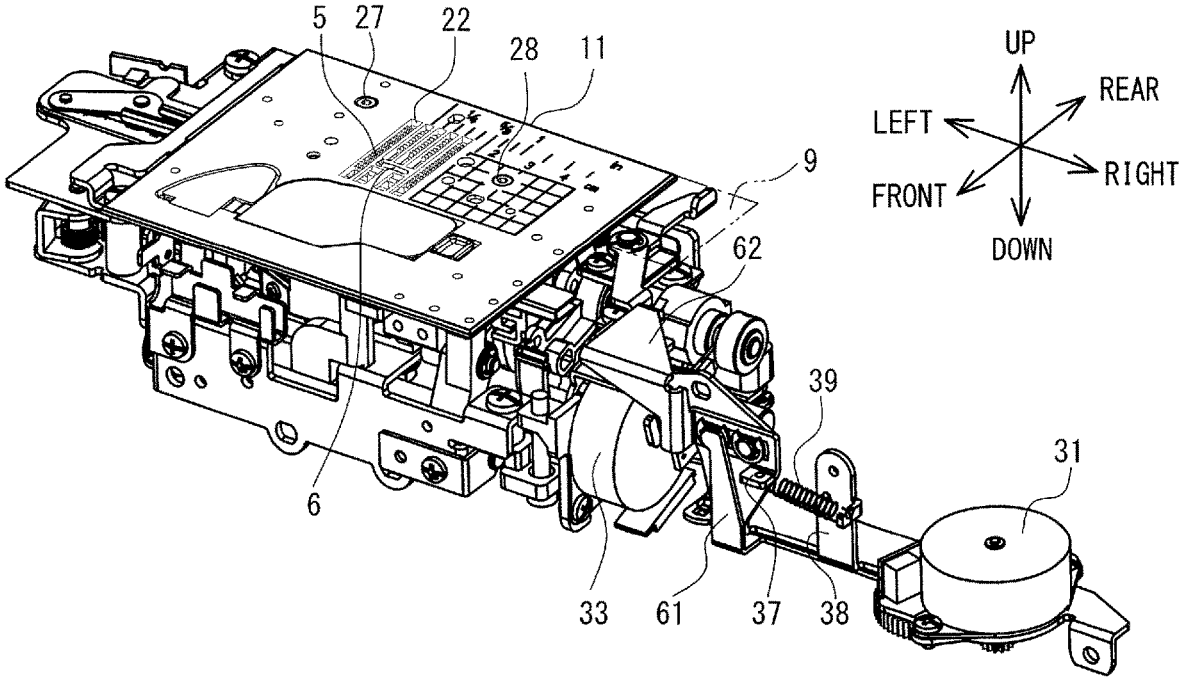
FIG. 2 is a perspective view of the interior of a bed portion.

Hereinafter, a sewing machine 1 according to an embodiment of the present disclosure will be explained with reference to the drawings. The drawings referred to are used to explain technological features that can be adopted by the present disclosure, and device configurations and the like illustrated in the drawings are merely explanatory examples and are not intended to limit the present disclosure thereto.

A physical configuration of the sewing machine 1 will be explained with reference to FIG. 1 to FIG. 4. In the explanation below, the lower left side, the upper right side, the upper left side and the lower right side in FIG. 1 are respectively defined as the left side, the right side, the rear side and the front side of the sewing machine 1.

As shown in FIG. 1, the sewing machine 1 is mainly configured by a bed portion 2, a pillar 3 and an arm portion 4. The pillar 3 is provided on the right end portion of the bed portion 2, and extends in the vertical direction from the bed portion 2. The arm portion 4 extends to the left from the upper end portion of the pillar 3 such that the arm portion 4 faces the bed portion 2. The leading end portion of the arm portion 4 is a head portion 40.

The bed portion 2 has an upper surface that extends horizontally, and removably supports a needle plate 11 and a cover 9. The needle plate 11 is a rectangular plate in a plan view. The needle plate 11 is removably mounted in an opening 98 that is provided in the upper surface of the bed portion 2. As shown in FIG. 2 and FIG. 3A to FIG. 3C, the needle plate 11 has a needle hole 6, square holes 22, holes 27 and 28, a first engagement member 15, and a pair of front and rear hook portions 97. The needle hole 6 is provided in a substantially central portion of the needle plate 11, and is a hole through which a sewing needle 95 to be described later can be inserted. The square holes 22 are arranged to the front, rear, left and right of the needle hole 6, and are a plurality of holes that extend in the front-rear direction. The square holes 22 a hole through which a feed dog 5 can be inserted from below. The holes 27 and 28 are holes into which positioning pins 71 and 72 to be described later are inserted from below. The holes 27 and 28 of the present embodiment are circular holes in a plan view and penetrate the needle plate 11. The hole 27 is provided to the rear and the left of the needle hole 6, and the hole 28 is provided to the rear and the right of the needle hole 6. The square holes 22 are disposed between the hole 27 and the hole 28.

Figure 3A:
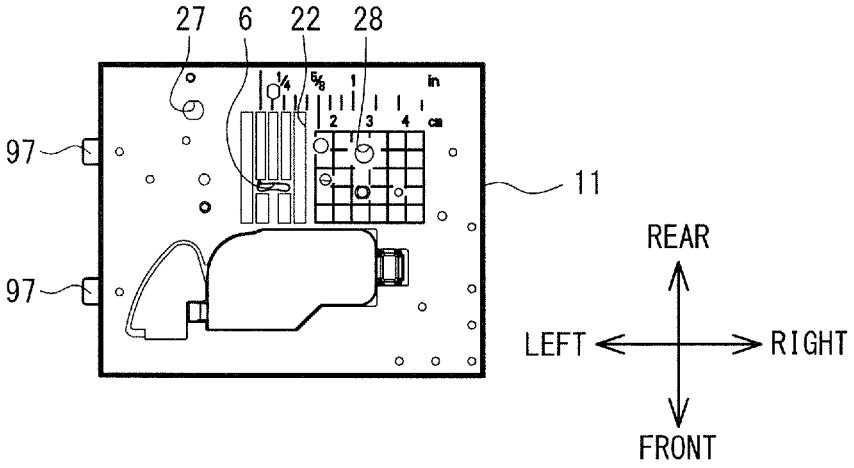
FIG. 3A is a plan view of a needle plate.
Figure 3B:
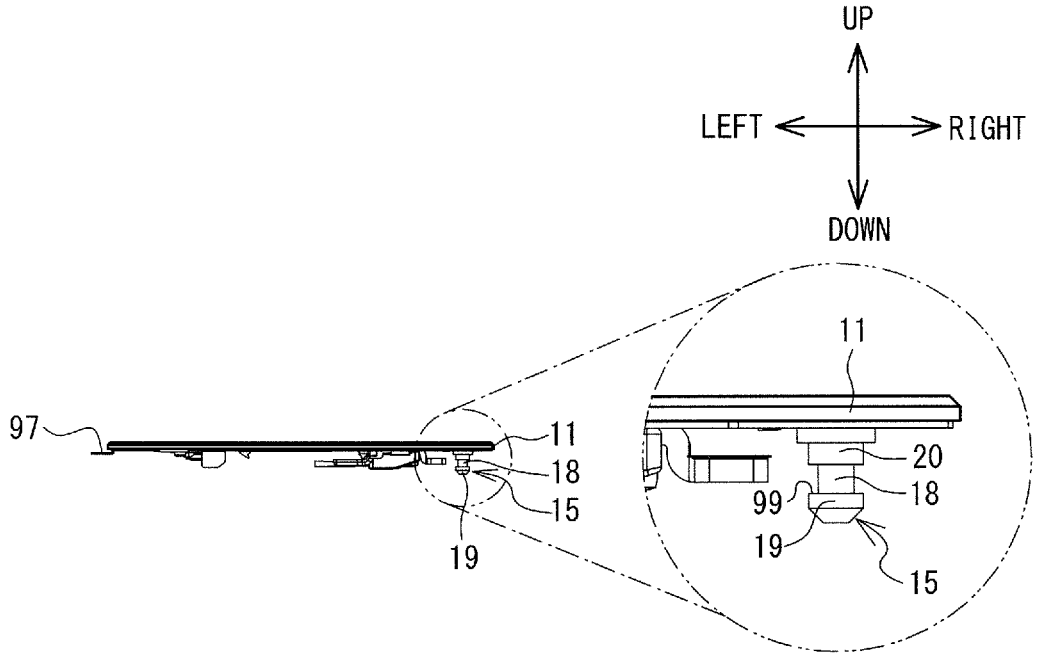
FIG. 3B is a front view of the needle plate.
Figure 3C:
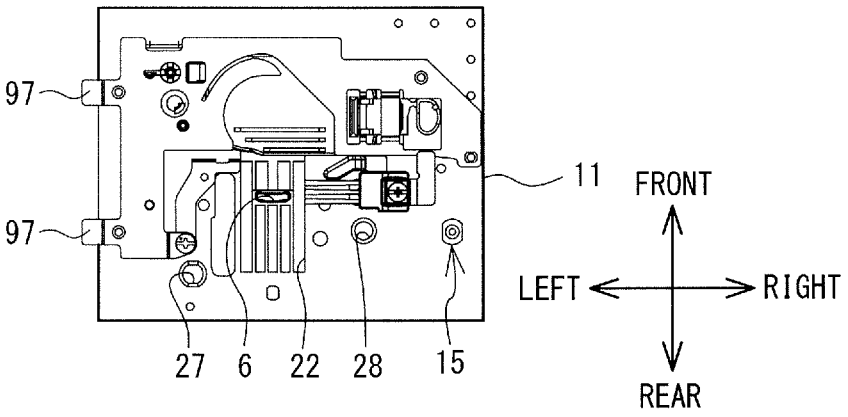
FIG. 3C is a bottom view of the needle plate.

As shown in FIG. 3B and FIG. 3C, the first engagement member 15 has a pin shape that extends from the lower surface of the needle plate 11 in a direction (a substantially vertical direction) that intersects an extending direction of the needle plate 11. The first engagement member 15 has an engagement portion 18 and a first convex portion 19. The engagement portion 18 engages with a second engagement member 16 to be described later. The first convex portion 19 is provided below the engagement portion 18, and protrudes further in the horizontal direction (a direction that intersects the extending direction of the first engagement member 15) than the engagement portion 18. A lower portion of the first convex portion 19 is chamfered. The first engagement member 15 further has a base portion 20. The base portion 20 is provided above the engagement portion 18, and protrudes further in the horizontal direction (the direction that intersects the extending direction of the first engagement member 15) than the engagement portion 18. The base portion 20 is coupled to the lower surface of the needle plate 11. In a plan view, outer peripheral portions of the first convex portion 19 and the base portion 20 are located outside an outer peripheral portion of the engagement portion 18.

The pair of front and rear hook portions 97 extend to the left from the left end of the lower surface of the needle plate 11, and are plate-shaped sections that extend in the left-right direction. When the needle plate 11 is disposed in a fixed position shown in FIG. 1, the pair of hook portions 97 are engaged with a left side portion of the rectangular opening 98. The cover 9 is a rectangular plate-shaped member in a plan view, and is smaller than the needle plate 11. On the right side of the needle plate 11, the cover 9 is removably supported by the bed portion 2. When the cover 9 is supported by the bed portion 2, the cover 9 forms a horizontal plane that is substantially flush with the upper surface of the bed portion 2, and covers a lever 64, to be described later, from above.

Figure 4A:
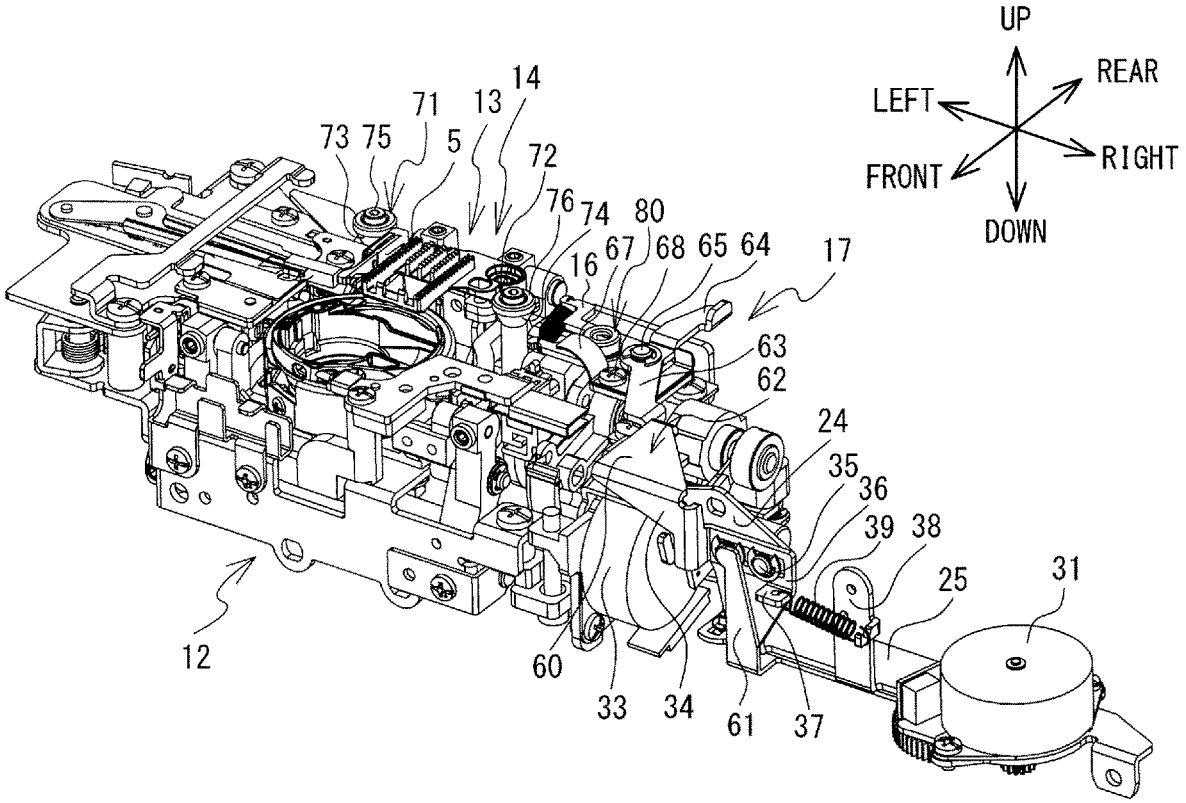
FIG. 4A is a perspective view of the interior of the bed portion when an output shaft is in a reference position and a feed dog is in a normal position.
Figure 4B:
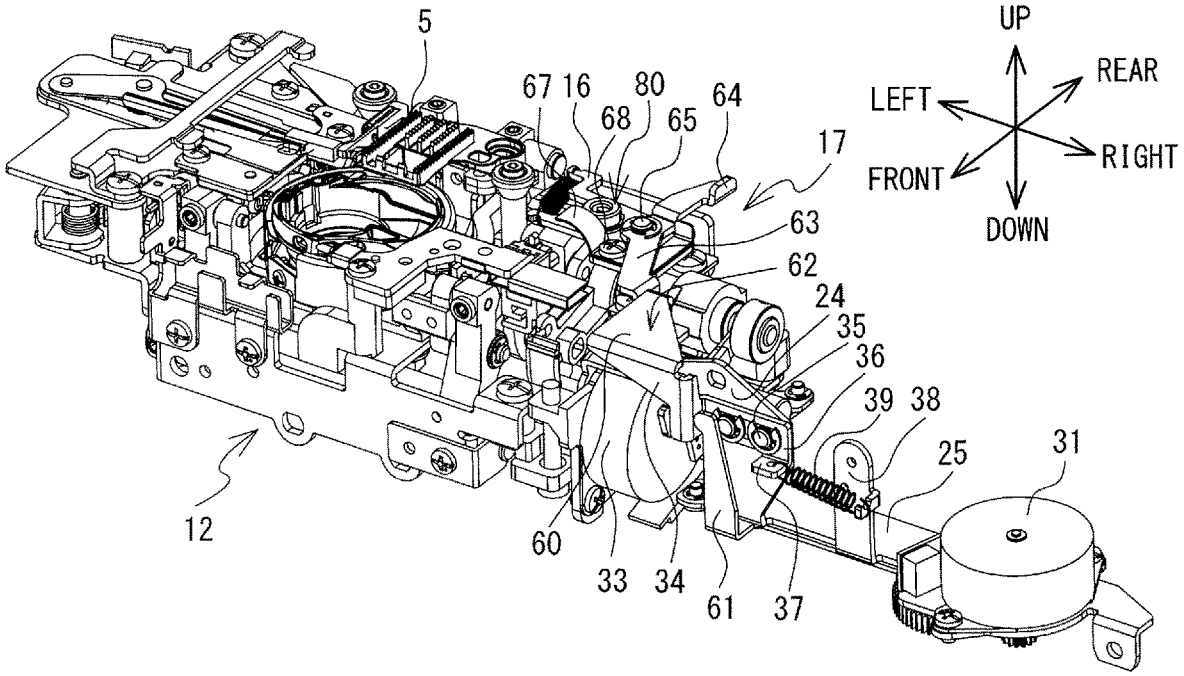
FIG. 4B is a perspective view of the interior of the bed portion in a state in which the output shaft is in a second actuated position, the feed dog is in a retracted position, and a lever is moved in a second direction in comparison to FIG. 4A.
Figure 5A:
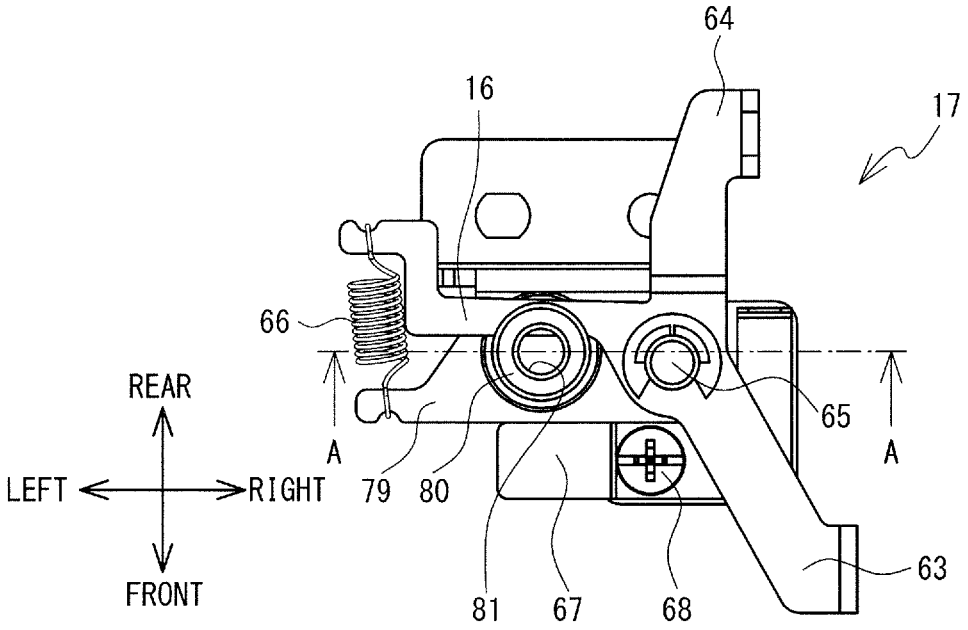
FIG. 5A is a plan view of a part of a lock release mechanism.

As shown in FIG. 4A and FIG. 5A, the sewing machine 1 is provided with a shuttle mechanism 12, the feed dog 5, a feed mechanism 13, a feed dog retraction mechanism 14, a first urging member 67, the second engagement member 16, a second urging member 66, a cylindrical portion 80, a lock release mechanism 17 and the positioning pins 71 and 72, inside the bed portion 2 below the needle plate 11. The shuttle mechanism 12 is provided below the needle plate 11, and is configured to rotate in conjunction with an up-down movement of a needle bar 8. The feed dog 5 moves a sewing object (for example, a work cloth) by a predetermined feed amount. The feed mechanism 13 is a known mechanism driven by a sewing machine motor as a drive source, and is configured to adjust the amount of feed by the feed dog 5, using a feed amount adjustment motor 33 as a drive source. The feed dog retraction mechanism 14 is coupled to an output shaft 32 (refer to FIGS. 8A-8C) of a movement motor 31, and is configured to switch the feed dog 5 between a normal position and a retracted position using the driving force of the movement motor 31. The movement motor 31 is a pulse motor. The normal position is a position in which the feed dog 5 is driven by the feed mechanism 13 and the feed dog 5 intermittently protrudes above the upper surface of the needle plate 11. The retracted position is a position in which the driving force of the feed mechanism 13 is not transmitted to the feed dog 5 and the feed dog 5 is retracted below the upper surface of the needle plate 11. For example, known mechanisms (for example, refer to Japanese Laid-Open Patent Publication No. 2007-244721, the relevant portions of which are herein incorporated by reference) can be adopted as the feed mechanism 13 and the feed dog retraction mechanism 14. The feed dog retraction mechanism 14 will be described in more detail later.

Figure 5B:
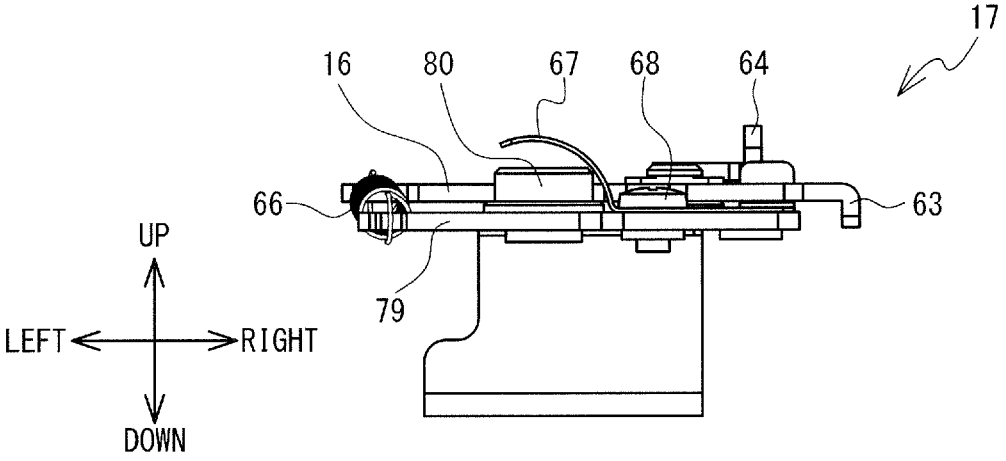
FIG. 5B is a front view of the part of the lock release mechanism.

As shown in FIG. 5A and FIG. 5B, the first urging member 67 is provided inside the bed portion 2 and urges the needle plate 11 upward. The first urging member 67 of the present embodiment is a plate spring that is curved upward in a convex shape, and the right end the first urging member 67 is fixed using a screw 68. The first urging member 67 upwardly urges a substantially central portion in the front-rear direction of the right end portion of the needle plate 11 on the opposite side to the side (the left side) of the needle plate 11 on which the hook portions 97 are provided. The second engagement member 16 is provided inside the bed portion 2, and engages with the first engagement member 15 of the needle plate 11 that is pressed downward against an urging force of the first urging member 67, thus fixing the needle plate 11 in the fixed position. When the needle plate 11 is in the fixed position, the upper surface of the needle plate 11 is on substantially the same horizontal plane as the upper surface of the bed portion 2. The second engagement member 16 of the present embodiment is a plate-shaped member, and extends in the direction that intersects the extending direction of the first engagement member 15.

The second urging member 66 is fixed to one end (the left end) of the second engagement member 16, and urges the second engagement member 16 such that the second engagement member 16 can rotate in a first direction (a counter-clockwise direction in a plan view) that intersects with the up-down direction. The first direction of the present embodiment is the horizontal direction. The second urging member 66 of the present embodiment is a coil spring, and the other end of the second urging member 66 is fixed to the left end portion of a plate portion 79 that extends substantially horizontally in a position to the front of the second engagement member 16. The cylindrical portion 80 is a circular cylindrical section having a hole 81 that extends in the up-down direction. The diameter of the hole 81 is larger than the diameter of the first engagement member 15. When the needle plate 11 is disposed in the fixed position, the first engagement member 15 is inserted through the hole 81 of the cylindrical portion 80 from above. The upper end of the cylindrical portion 80 is located higher than the upper surface of the second engagement member 16. The second engagement member 16 extends in the left-right direction in a position to the rear of the cylindrical portion 80. The cylindrical portion 80 has a cutout portion that is cut out in the up-down direction, in a section (namely, a back surface side) of the cylindrical portion 80 that faces the second engagement member 16. As shown in FIG. 5A, the second engagement member 16 is urged in the counterclockwise direction in a plan view by an urging force of the second urging member 66, and is inserted into the cutout portion from the rear.

The lock release mechanism 17 is configured to release the engagement of the first engagement member 15 and the second engagement member 16. The lock release mechanism 17 will be described in detail later. The positioning pins 71 and 72 are columnar members that extend upward. When the second engagement member 16 and the first engagement member 15 are engaged with each other, the upper ends of the positioning pins 71 and 72 are lower than the height of the upper surface of the needle plate 11 in the fixed position. As shown in FIG. 4A, the upper ends of the positioning pins 71 and 72 are respectively provided with second convex portions 73 and 74 that protrude in the horizontal direction in positions below the needle plate 11 in the fixed position. The second convex portions 73 and 74 have a columnar shape, and have the same axial line as the positioning pins 71 and 72. Cushion materials 75 and 76 are respectively disposed on the upper ends of the second convex portions 73 and 74. The cushion materials 75 and 76 are elastic members, such as unwoven cloth, felt or the like.

As shown in FIG. 1, the sewing machine 1 is provided with the sewing machine motor (not shown in the drawings) below the pillar 3. The driving force of the sewing machine motor is transmitted to a drive shaft (not shown in the drawings) via a drive belt (not shown in the drawings). The drive shaft extends in the left-right direction inside the arm portion 4. The driving force of the sewing machine motor is also transmitted to a lower shaft (not shown in the drawings) by a transmission mechanism (not shown in the drawings) provided at a midway portion of the drive shaft. The lower shaft extends in the left-right direction inside the bed portion 2.

The pillar 3 of the sewing machine 1 is provided with a vertically long liquid crystal display (hereinafter simply referred to as an "LCD") 10 and a touch panel 26. The LCD 10 displays function names to execute various functions necessary for sewing operations, such as selection and editing of a pattern to be sewn, various messages, and the like. The touch panel 26 is provided on the front surface of the LCD 10. When a user selects an item displayed on the LCD 10 using a finger or a dedicated pen, which item is selected is detected by the touch panel 26. The user can input various commands via the touch panel 26.

An upper portion of the arm portion 4 is provided with a cover 92 that can be opened and closed. FIG. 1 shows a state in which the cover 92 is open. A housing portion 94 is provided below the cover 92 in a closed state, namely, inside the arm portion 4. The housing portion 94 is a recessed portion that houses a thread spool 96 around which an upper thread is wound. A thread spool pin 93 is disposed on an inner wall surface of the housing portion 94 on the pillar 3 side. The thread spool pin 93 protrudes toward the head portion 40 so that the thread spool 96 can be mounted on the thread spool pin 93. The thread spool 96 is mounted on the sewing machine 1 by the thread spool pin 93 being inserted into an insertion hole provided in the thread spool 96. The needle bar 8 is disposed on a lower portion of the head portion 40. The sewing needle 95 can be mounted on the lower end of the needle bar 8. A needle bar up-and-down movement mechanism (not shown in the drawings) and a thread take-up lever mechanism (not shown in the drawings) are provided inside the head portion 40. The needle bar up-and-down movement mechanism causes the needle bar 8 having the sewing needle 95 mounted thereon to drive in the up-down direction.

A thread guide groove 7 is provided in the arm portion 4. The thread guide groove 7 guides the upper thread pulled out from the thread spool 96, finally, to the sewing needle 95, via a tensioner mechanism, a thread take-up spring, a thread take-up lever and the like that are not shown in the drawings. A start/stop switch 91 is provided on the front surface of the arm portion 4. The start/stop switch 91 is a switch to issue a command to start or stop a sewing operation. When the start/stop switch 91 is depressed, the sewing machine motor is driven, and respective elements including the needle bar up-and-down movement mechanism, the thread take-up lever mechanism, the shuttle mechanism 12 and the feed mechanism 13 are driven in synchronization with each other. Thus, stitches are formed on the sewing object.

The feed dog retraction mechanism 14 will be explained with reference to FIGS. 7A-7C and FIGS. 8A-8C. The feed dog retraction mechanism 14 is provided with a gear 41, a drop cam 42, actuation pieces 43, 48 and 52, a contactor 86 and an up-down feed cam 85. The gear 41 is fixed to the leading end of the output shaft 32 of the movement motor 31. The output shaft 32 extends in the up-down direction. The gear 41 meshes with gear teeth provided on the outer periphery of the drop cam 42. The diameter of the drop cam 42 is larger than the diameter of the gear 41. A shaft 47 of the drop cam 42 extends in the up-down direction. The drop cam 42 has a spiral groove portion 88 that extends from the shaft 47 in the counterclockwise direction in a bottom view. The actuation piece 43 extends in the left-right direction, and is provided with a columnar convex portion 87 that protrudes downward, a long hole 44 disposed in the left end portion of the actuation piece 43, and a long hole 45 disposed in the right end portion of the actuation piece 43. The long holes 44 and 45 are long in the left-right direction. The convex portion 87 is inserted into the groove portion 88 of the drop cam 42. A pin 46 that extends in the up-down direction is inserted through the long hole 44. The shaft 47 is inserted through the long hole 45. When the gear 41 rotates, the drop cam 42 rotates and the arrangement of the groove portion 88 is changed. The actuation piece 43 is guided by the groove portion 88 and the long holes 44 and 45 in accordance with the rotation of the drop cam 42, and can move in the left-right direction.

Figures 8A, 8B, 8C:
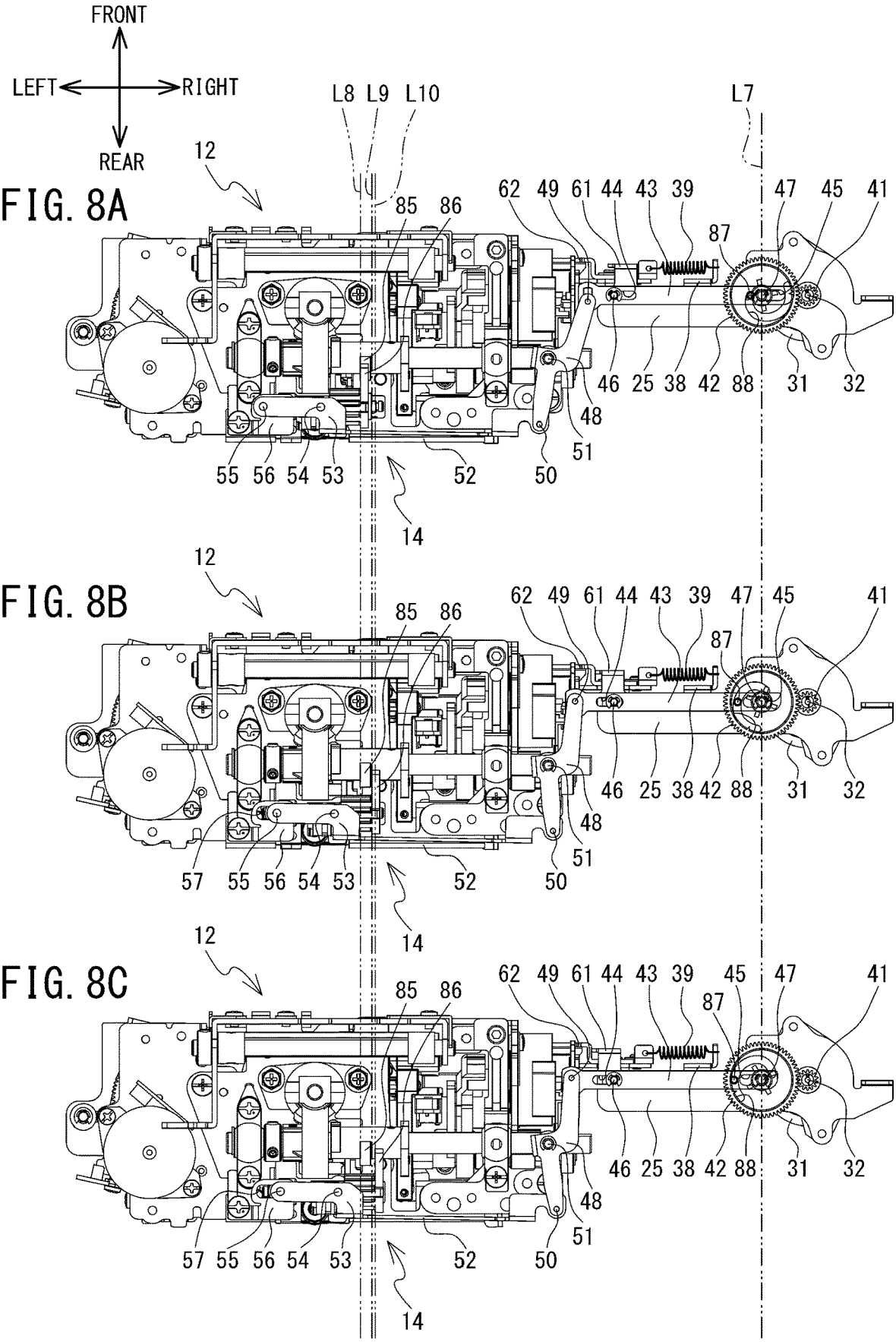
FIG. 8A is a bottom view of the interior of the bed portion when the output shaft is in the reference position and the feed dog is in the normal position.
FIG. 8B is a bottom view of the interior of the bed portion when the output shaft is in the first actuated position and the feed dog is in the retracted position.
FIG. 8C is a bottom view of the interior of the bed portion in a state in which the output shaft is in the second actuated position, the feed dog is in the retracted position, and the lever is rotated in the second direction in comparison to FIG. 8A and FIG. 8B.

The left end portion of the actuation piece 43 is coupled to the actuation piece 48 by a pin 49 that extends in the up-down direction. The actuation piece 48 is a plate-shaped member that extends in the front-rear direction. A columnar pin 51, which extends in the up-down direction, is inserted through a substantially central portion in the front-rear direction of the actuation piece 48. The actuation piece 48 is fixed such that the actuation piece 48 can rotate around the pin 51. The rear end portion of the actuation piece 48 is coupled to the actuation piece 52 by a pin 50 that extends in the up-down direction. The actuation piece 52 is a plate-shaped member that is long in the left-right direction and that is disposed at the rear end portion of the interior of the bed portion 2. A left portion of the actuation piece 52 has a plate-shaped plate portion 53 that extends in the horizontal direction. Pins 54 and 55, which extend upward from the upper surface of the plate portion 53, are arranged side by side in the left-right direction on the plate portion 53. The pin 55 disposed to the left of the pin 54 is inserted through a long hole 57 that is provided in a plate-shaped member 56 that extends in the horizontal direction above the plate portion 53. The long hole 57 extends in the left-right direction. The actuation piece 52 is guided by the long hole 57 and can move in the left-right direction. The contactor 86 is fixed to the upper surface of the plate portion 53. The contactor 86 is provided below the up-down feed cam 85. The up-down feed cam 85 is an eccentric cam that is firmly fixed to the lower shaft (not shown in the drawings). As shown in FIG. 8A, the contactor 86 is disposed below the up-down feed cam 85. When the contactor 86 comes into contact with the up-down feed cam 85, the driving force of the up-down feed cam 85 is transmitted to the feed dog 5, and the feed dog 5 is driven to swing in the front-rear direction and the up-down direction. In other words, when the contactor 86 comes into contact with the up-down feed cam 85, the contactor 86 causes the feed dog 5 to be disposed in the normal position. As shown in FIG. 8B, when the contactor 86 does not come into contact with the up-down feed cam 85, the contactor 86 causes the feed dog 5 to be disposed in the retracted position.

Figure 9A:
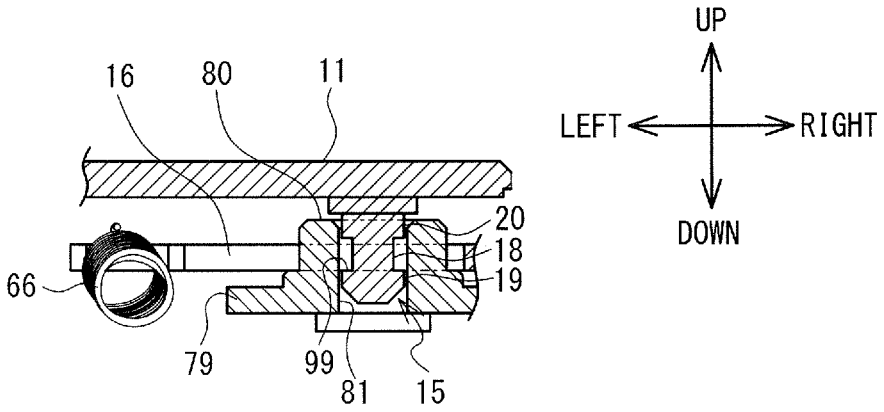
FIG. 9A is a partial sectional view, taken in the direction of arrows along a line A-A shown in FIG. 5, that shows a state in which a first engagement member and a second engagement member are engaged with each other.

A procedure used when the needle plate 11 is disposed in the fixed position shown in FIG. 1 will be explained. The user causes the hook portions 97 to be engaged with the left side portion of the opening 98 of the bed portion 2, and presses down the right end portion of the needle plate 11 in a state in which the positioning pins 71 and 72 are respectively inserted through the holes 27 and 28. When the user presses down the needle plate 11 against the urging force of the first urging member 67, the second engagement member 16 is guided to the first convex portion 19 whose lower portion is chamfered, and is engaged with the engagement portion 18 of the first engagement member 15 of the needle plate 11 pressed down against the urging force of the first urging member 67. When the user stops pressing down the needle plate 11, the right end portion of the needle plate 11 is moved upward by the urging force of the first urging member 67 to a position at which an upper end 99 of the first convex portion 19 comes into contact with the lower surface of the second engagement member 16. As a result, as shown in FIG. 9A, when the first engagement member 15 and the second engagement member 16 are engaged with each other, the second engagement member 16 comes into contact with the engagement portion 18 of the first engagement member 15 due to the urging force of the second urging member 66, and also comes into contact with the upper end 99 of the first convex portion 19 of the first engagement member 15 due to the urging force of the first urging member 67.

The lock release mechanism 17 will be explained with reference to FIG. 4 to FIG. 8C. The lock release mechanism 17 is configured such that the engagement of the first engagement member 15 and the second engagement member 16 can be released manually. As shown in FIG. 5A and FIG. 5B, the lock release mechanism 17 is provided with the lever 64. The lever 64 is provided below the upper surface of the bed portion 2. The lever 64 can rotate the second engagement member 16 in a second direction (a clockwise direction in a plan view) opposite to the first direction (the counterclockwise direction in a plan view). The lever 64 is a plate-shaped member that extends in the front-rear direction. The right end portion of the lever 64 bends upward. The lever 64 is covered by the cover 9 from above. When the cover 9 is removed from the bed portion 2, the lever 64 can be exposed on the upper surface side of the bed portion 2. The front end portion of the lever 64 is coupled to the right end of the second engagement member 16. A coupling portion of the lever 64 and the second engagement member 16 is fixed by a pin 65, which extends in the up-down direction, such that the coupling portion can rotate along the horizontal direction. The pin 65 is disposed to the right of the cylindrical portion 80. The pin 65 is provided on an opposite side to the second urging member 66 with respect to the cylindrical portion 80. The lever 64 and the second engagement member 16 can integrally rotate around the pin 65 along the horizontal plane.

Figure 9B:
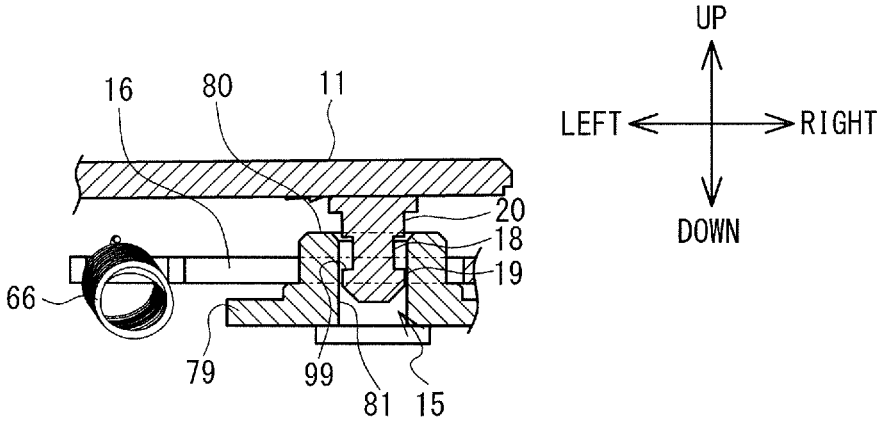
FIG. 9B is a partial sectional view, taken in the direction of the arrows along the line A-A shown in FIG. 5, that shows a state in which the engagement of the first engagement member and the second engagement member is released by the lock release mechanism.

When the engagement of the first engagement member 15 and the second engagement member 16 is released manually, the user removes the cover 9 from the bed portion 2, and causes the lever 64 to be exposed on the upper surface side of the bed portion 2. The user rotates the lever 64 in the second direction (the clockwise direction in a plan view). The second engagement member 16 rotates in the second direction around the pin 65 integrally with the lever 64, against the urging force of the second urging member 66. The second engagement member 16 separates from the engagement portion 18 of the first engagement member 15 in the horizontal direction. When the second engagement member 16 moves to a position at which the second engagement member 16 is not in contact with the upper end of the first convex portion 19, the needle plate 11 is moved upward by the urging force of the first urging member 67. As a result, as shown in FIG. 9B, the engagement of the first engagement member 15 and the second engagement member 16 is released. The right end portion of the needle plate 11 is positioned higher than the upper surface of the bed portion 2. The user pinches the right end portion of the needle plate 11 and removes the needle plate 11.

The lock release mechanism 17 of the present embodiment is further configured such that the engagement of the first engagement member 15 and the second engagement member 16 can be released using the movement motor 31 as the drive source. Specifically, as shown in FIG. 5A, FIG. 5B and FIGS. 6A-6C, the lock release mechanism 17 is further provided with a lever 63, a pressing member 62 and a movement member 61. The lever 63 has a plate shape that extends forward and diagonally to the right from the coupling portion of the lever 64 and the second engagement member 16. The right end of the lever 63 bends downward. The length of the lever 63 in the front-rear direction is longer than the length of the lever 64 in the front-rear direction. The right end of the lever 63 is located further to the right than the right end of the lever 64. When the cover 9 is removed from the bed portion 2, the lever 63 is covered by the upper surface of the bed portion 2 from above. The lever 63 and the second engagement member 16 can integrally rotate around the pin 65 along the horizontal plane.

The pressing member 62 is a member that can move the right end of the lever 63 in the second direction in accordance with the position of the movement member 61. The pressing member 62 is located to the right of the lever 63 and is supported such that the pressing member 62 can move in the left-right direction. Specifically, as shown in FIGS.

7A-7C, the pressing member 62 is provided with a main body portion 60, a coupling portion 34 and a support portion 36. The main body portion 60 is a plate-shaped section having a triangular shape in a plan view and extends horizontally. The main body portion 60 is provided to the right of the lever 63. The front end of the main body portion 60 is coupled to the coupling portion 34. The coupling portion 34 is a triangular section in a front view and extends downward from the front end of the main body portion 60. The right end of the coupling portion 34 is coupled to the support portion 36. The support portion 36 extends rearward from the right end of the coupling portion 34, and further bends to the right. The support portion 36 is a plate-shaped section having an L shape in a plan view. The right end portion of the support portion 36 that extends in the left-right direction has a long hole that extends in the left-right direction. Two pins 35, which extend in the front-rear direction, are inserted through the long hole. The two pins 35 are arranged side by side in the left-right direction, and are fixed to a plate-shaped support portion 24 that extends upward from the front left end portion of a fixing plate 25. The fixing plate 25 is a plate member that extends horizontally, and the movement motor 31 is fixed to the right end portion of the fixing plate 25. The pressing member 62 is fixed to the support portion 24 such that the pressing member 62 can move along the long hole. The right end portion of the support portion 36 has a fixing portion 37 which protrudes forward and to which one end of an urging member 39 is fixed. The other end of the urging member 39 is fixed to a plate-shaped support portion 38 that extends in the up-down direction from the front end portion of the fixing plate 25 in a position to the right of the support portion 24. The urging member 39 is a coil spring. The pressing member 62 is urged by the urging member 39 in the rightward direction that is opposite to the movement direction (the leftward direction) when the lever 63 is rotated in the second direction.

The movement member 61 is configured to be movable in the left-right direction in accordance with the position of the output shaft 32 of the movement motor 31. The movement member 61 is a plate-shaped section that extends upward from the front left end portion of the actuation piece 43. The movement member 61 can move in the left-right direction integrally with the actuation piece 43 in accordance with a rotation angle of the movement motor 31. The upper left end portion of the movement member 61 protrudes to the left in an arc shape. The left end portion of the support portion 36 of the pressing member 62 is disposed on the left side of the upper left end portion of the movement member 61. The right end portion of the pressing member 62 is disposed on the rear side of the movement member 61.

Figure 6A:
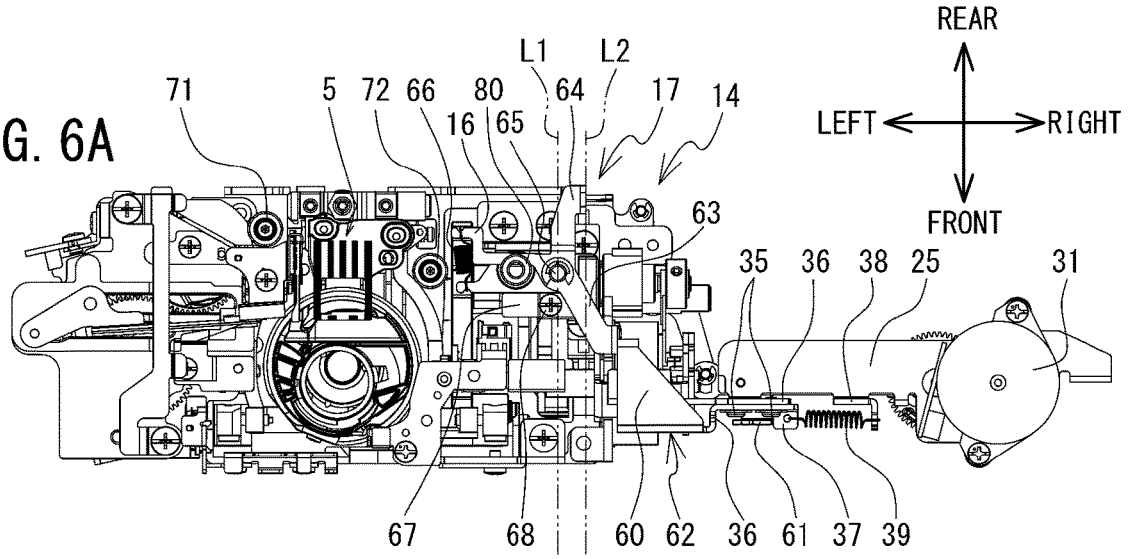
FIG. 6A is a plan view of the interior of the bed portion when the output shaft is in the reference position and the feed dog is in the normal position.
Figure 6B:
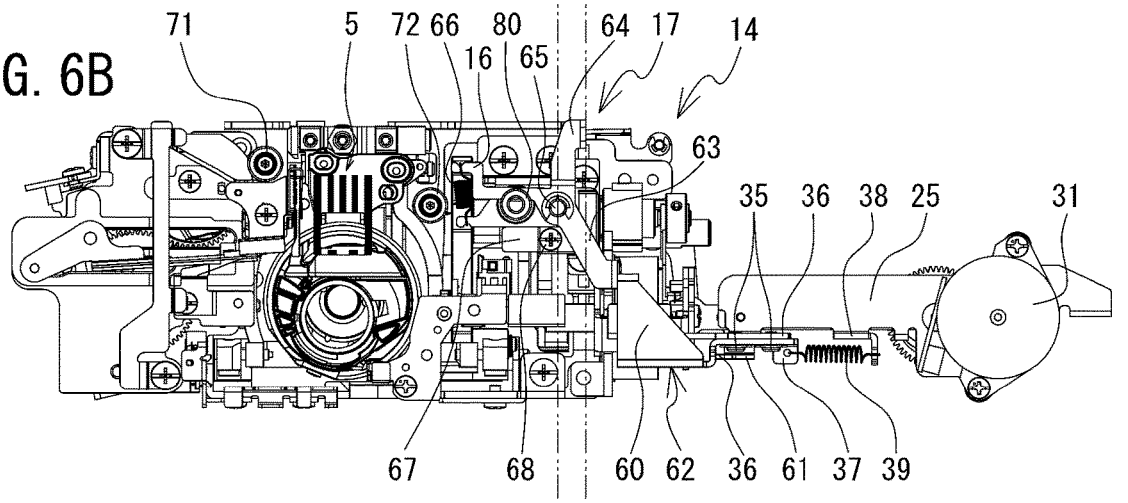
FIG. 6B is a plan view of the interior of the bed portion when the output shaft is in a first actuated position and the feed dog is in the retracted position.
Figure 6C:
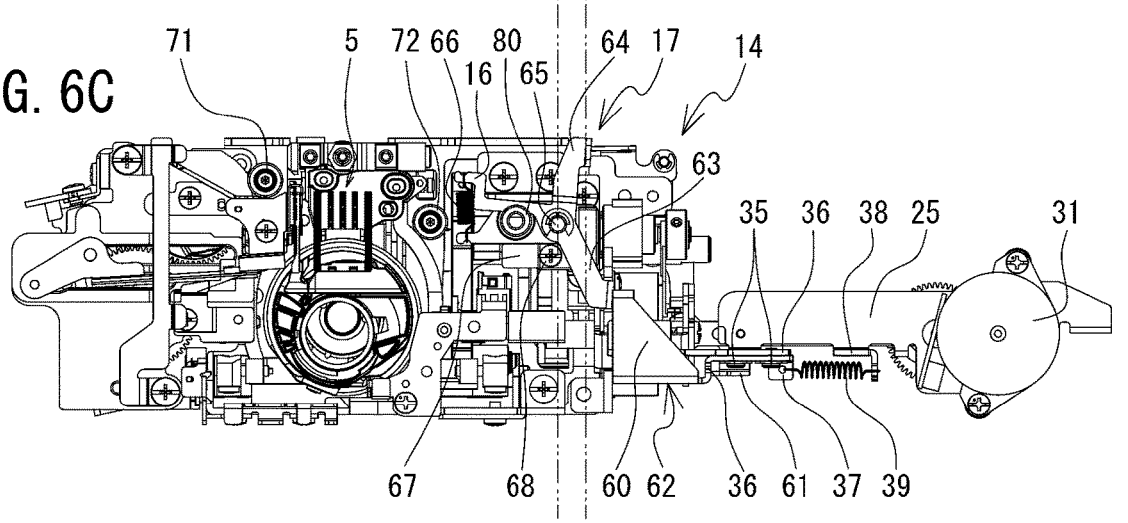
FIG. 6C is a plan view of the interior of the bed portion in a state in which the output shaft is in the second actuated position, the feed dog is in the retracted position, and the lever is rotated in the second direction in comparison to FIG. 6A and FIG. 6B.
Figure 7A:
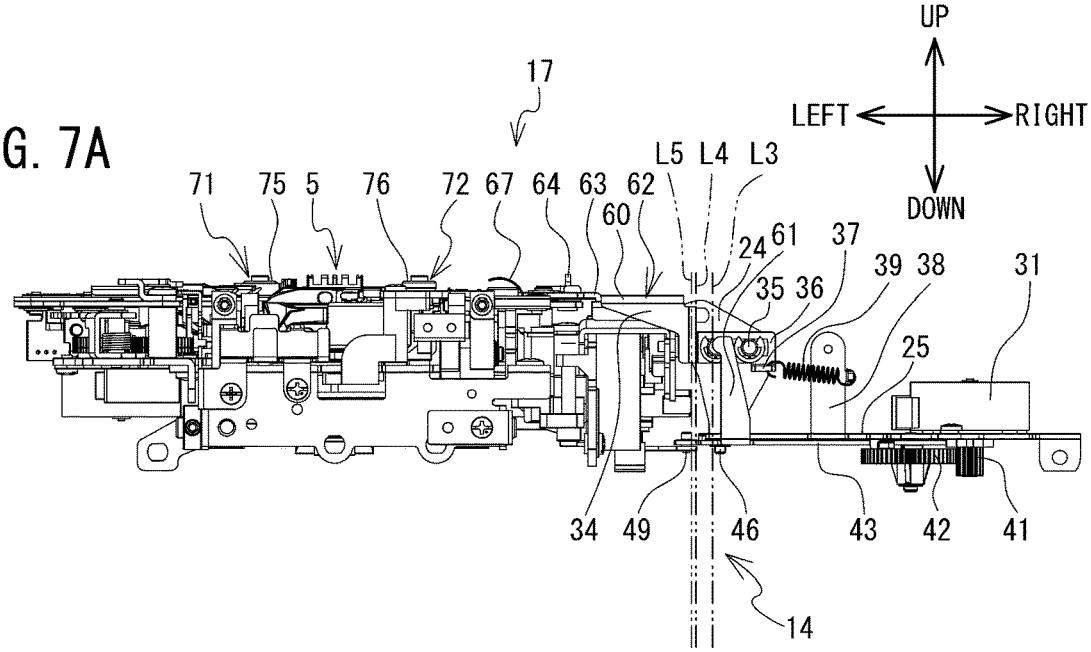
FIG. 7A is a front view of the interior of the bed portion when the output shaft is in the reference position and the feed dog is in the normal position.
Figure 7B:
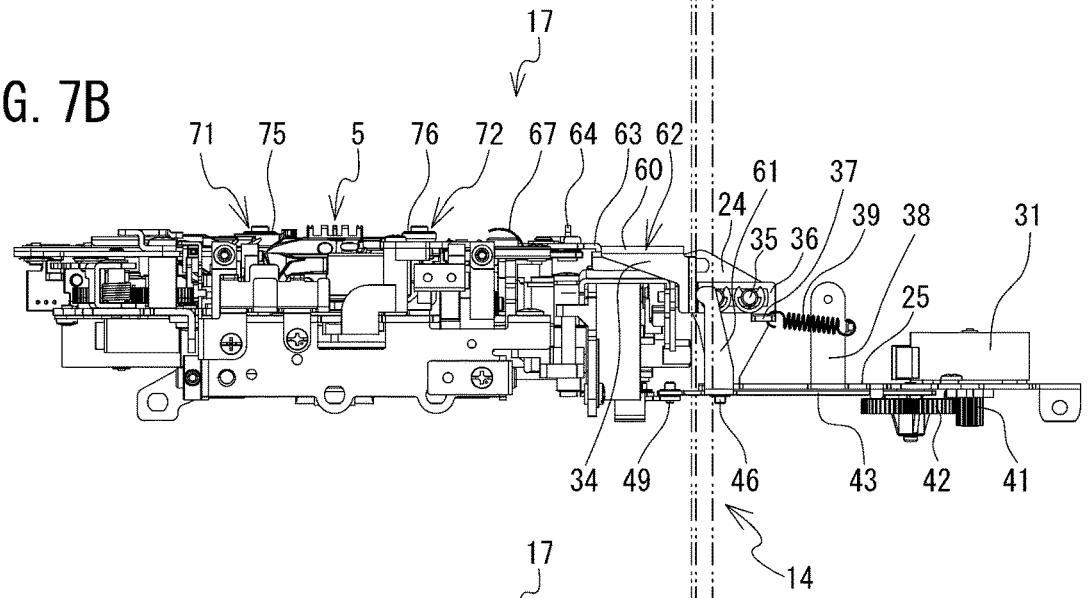
FIG. 7B is a front view of the interior of the bed portion when the output shaft is in the first actuated position and the feed dog is in the retracted position.
Figure 7C:
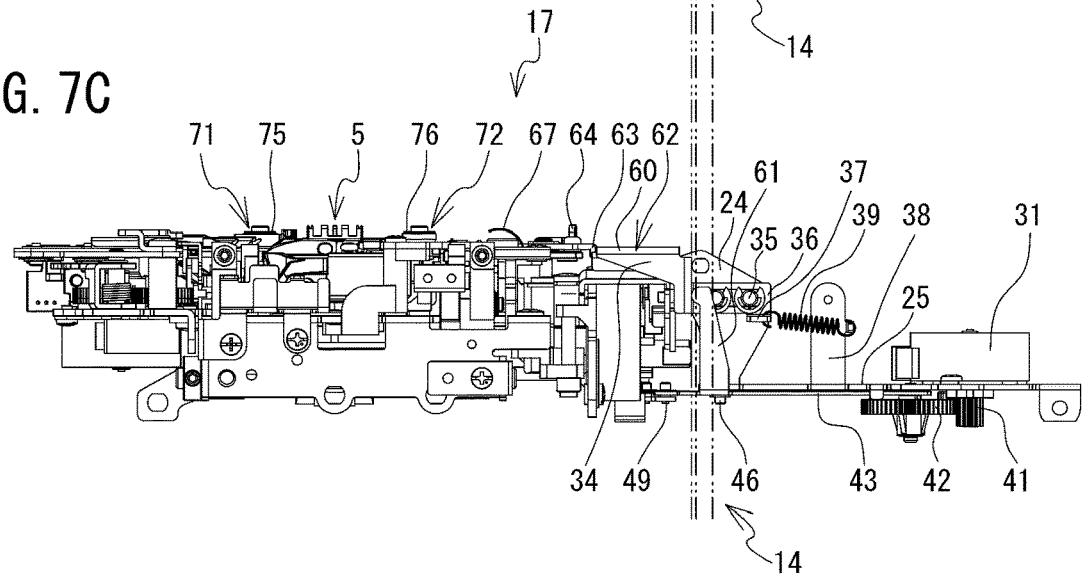
FIG. 7C is a front view of the interior of the bed portion in a state in which the output shaft is in the second actuated position, the feed dog is in the retracted position, and the lever is rotated in the second direction in comparison to FIG. 7A and FIG. 7B.

An operation to cause the feed dog retraction mechanism 14 to switch the feed dog 5 between the normal position and the retracted position using the movement motor 31 as the drive source, and an operation to cause the lock release mechanism 17 to release the engagement of the first engagement member 15 and the second engagement member 16 will be explained with reference to FIGS. 6A-6C, 7A-7C and 8A-8C. For example, when a command is input by the user via the touch panel 26, the movement motor 31 is driven by an amount corresponding to the command. Via the touch panel 26, the user can input each of a command to cause the feed dog retraction mechanism 14 to switch the feed dog 5 between the normal position and the retracted position, a command to cause the lock release mechanism 17 to release the engagement of the first engagement member 15 and the second engagement member 16, and a command to cause the first engagement member 15 and the second engagement member 16 to be in an engageable state. In FIGS. 6A-6C, a virtual line L1 indicates the central position of the pin 65. A virtual line L2 indicates the position of the right end of the lever 64 when the output shaft 32 is in a reference position. In FIGS. 7A-7C, a virtual line L3 indicates the position of the left end portion of the movement member 61 when the output shaft 32 is in the reference position. A virtual line L4 indicates the position of the left end portion of the movement member 61 when the output shaft 32 is in a first actuated position. A virtual line L5 indicates the position of the left end portion of the movement member 61 when the output shaft 32 is in a second actuated position. In FIGS. 8A-8C, a virtual line L7 indicates the central position of the shaft 47. A virtual line L8 indicates the position of the left end portion of the contactor 86 when the output shaft 32 is in the reference position. A virtual line L9 indicates the position of the left end portion of the contactor 86 when the output shaft 32 is in the first actuated position. A virtual line L10 indicates the position of the left end portion of the contactor 86 when the output shaft 32 is in the second actuated position.

As shown in FIG. 4A, FIG. 6A, FIG. 7A and FIG. 8A, when the output shaft 32 of the movement motor 31 is in the reference position (at a reference angle), the contactor 86 comes into contact with the up-down feed cam 85, and the feed dog retraction mechanism 14 causes the feed dog 5 to be disposed in the normal position. The pressing member 62 comes into contact with the lever 63. The pressing member 62 separates from the movement member 61. The second engagement member 16 is in a position in which the second engagement member 16 can engage with the first engagement member 15.

When the command to cause the feed dog retraction mechanism 14 to switch the feed dog 5 from the normal position to the retracted position is input, the movement motor 31 is driven and the output shaft 32 of the movement motor 31 is rotated to the first actuated position (a first operating angle). The first actuated position is a position at which the output shaft 32 of the movement motor 31 is rotated by a predetermined angle, which is smaller than 360 degrees, in a predetermined direction from the reference position. In this case, as shown in FIG. 6B, FIG. 7B and FIG. 8B, the actuation piece 43 of the feed dog retraction mechanism 14 is moved further to the left than when the output shaft 32 is in the reference position. In accordance with the movement of the actuation piece 43, the actuation piece 48 rotates around the pin 51 in the counterclockwise direction in a bottom view. In accordance with the rotation of the actuation piece 48, the actuation piece 52 is guided by the long hole 57 and moves to the right. As a result, the contactor 86 moves to a position at which the left end of the contactor 86 reaches the position indicated by the virtual line L9 in FIGS. 8A-8C, and separates from the up-down feed cam 85 in the left-right direction. The feed dog retraction mechanism 14 causes the feed dog 5 to be disposed in the retracted position.

The pressing member 62 comes into contact with the lever 63. The movement member 61 moves to the position indicated by the virtual line L4 in FIG. 7B, and comes into contact with the pressing member 62. An operation performed when a command is input to cause the feed dog retraction mechanism 14 to switch the feed dog 5 from the retracted position to the normal position is the reverse of the above-described operation.

When the command to cause the lock release mechanism 17 to release the engagement of the first engagement member 15 and the second engagement member 16 is input, the output shaft 32 of the movement motor 31 is rotated to the second actuated position (a second operating angle). The second actuated position is a position at which the output shaft 32 is further rotated in the predetermined direction from the first actuated position. In this case, as shown in FIG. 4B, FIG. 6C, FIG. 7C and FIG. 8C, the actuation piece 43 of the feed dog retraction mechanism 14 is moved slightly further to the left than when the output shaft 32 is in the first actuated position. In accordance with the movement of the actuation piece 43, the actuation piece 48 rotates around the pin 51 in the counterclockwise direction in a bottom view. In accordance with the rotation of the actuation piece 48, the actuation piece 52 is guided by the long hole 57 and moves to the right. As a result, the contactor 86 moves to a position at which the left end of the contactor 86 reaches the position indicated by the virtual line L10 in FIGS. 8A-8C, and separates from the up-down feed cam 85 in the left-right direction. Then, the feed dog retraction mechanism 14 causes the feed dog 5 to be disposed in the retracted position.

The movement member 61 of the lock release mechanism 17 moves to the position indicated by the virtual line L5 in FIG. 7C, while pressing the pressing member 62 to the left. The pressing member 62 moves to the left integrally with the movement member 61 against the urging force of the urging member 39, and pushes the lever 63 to the left. The lever 63 rotates in the second direction (the clockwise direction in a plan view) around the pin 65 against the urging force of the second urging member 66. Thus, in the same manner as in the case of the lever 64, the lock release mechanism 17 releases the engagement of the first engagement member 15 and the second engagement member 16. Due to the urging force of the first urging member 67, a section of the needle plate 11 that comes into contact with the first urging member 67 moves upward, as shown in FIG. 9B. The upper surface of the right end portion of the needle plate 11 is positioned higher than the upper surface of the bed portion 2. An operation performed when the command is input to cause the first engagement member 15 and the second engagement member 16 to be in the engageable state is the reverse of the above-described operation, except the operation of the needle plate 11 (the first engagement member 15).

In the sewing machine 1 of the above-described embodiment, when the user fixes the needle plate 11 to the bed portion 2, it is sufficient that the user causes the first engagement member 15 and the second engagement member 16 to be engaged with each other. When the user removes the needle plate 11 from the bed portion 2, it is sufficient that the user uses the lock release mechanism 17 to release the engagement of the first engagement member 15 and the second engagement member 16. Thus, in the sewing machine 1, it is possible to remove the needle plate 11 from the bed portion 2 with a simpler operation than in related art.

The sewing machine 1 is further provided with the second urging member 66 that urges the second engagement member 16 such that the second engagement member 16 can rotate in the first direction that intersects with the up-down direction. The first engagement member 15 extends downward from the lower surface of the needle plate 11, and has the engagement portion 18 that engages with the second engagement member 16, and the first convex portion 19 provided below the engagement portion 18 and protrudes further in the horizontal direction than the engagement portion 18. The lock release mechanism 17 has the lever 64 configured to rotate the second engagement member 16 in the second direction that is opposite to the first direction. When the first engagement member 15 and the second engagement member 16 are engaged with each other, the second engagement member 16 comes into contact with the engagement portion 18 of the first engagement member 15 due to the urging force of the second urging member 66, and also comes into contact with the upper end of the first convex portion 19 of the first engagement member 15 due to the urging force of the first urging member 67. Thus, in the sewing machine 1, the first engagement member 15 and the second engagement member 16 can have a relatively simple configuration. With a simple operation of pressing down the needle plate 11 against the urging force of the first urging member 67, the user can cause the first engagement member 15 and the second engagement member 16 to be engaged with each other.

The sewing machine 1 is further provided with the positioning pins 71 and 72 that extend upward inside the bed portion 2. The needle plate 11 is provided with the holes 27 and 28 into which the positioning pins 71 and 72 are inserted. Thus, by disposing the positioning pins 71 and 72 in the holes 27 and 28, the sewing machine 1 can suppress positional displacement of the needle plate 11 in the horizontal direction with respect to the bed portion 2. When the second engagement member 16 and the first engagement member 15 are engaged with each other, the upper ends of the positioning pins 71 and 72 are lower than the height of the upper surface of the needle plate 11 in the fixed position. Thus, in a state in which the needle plate 11 is in the fixed position, the sewing machine 1 can avoid the sewing being obstructed by the positioning pins 71 and 72.

The positioning pins 71 and 72 are respectively provided with the second convex portions 73 and 74 that protrude in the horizontal direction in the position below the needle plate 11 in the fixed position shown in FIG. 1, and the cushion materials 75 and 76 that are respectively disposed on the upper ends of the second convex portions 73 and 74. When the needle plate 11 is in the fixed position, the cushion materials 75 and 76 are disposed between the lower surface of the needle plate 11 and the upper surfaces of the second convex portions 73 and 74. Therefore, the sewing machine 1 can suppress collision noise from occurring between the needle plate 11 and the positioning pins 71 and 72 due to vibration and the like at the time of sewing.

The lever 64 is provided inside the bed portion 2 such that the lever 64 can be exposed on the upper surface side of the bed portion 2. In the sewing machine 1, the user can easily operate the lever 64. In the present embodiment, when the sewing is performed, the lever 64 can be covered by the cover 9 that forms the plane flush with the upper surface of the bed portion 2. Therefore, the sewing is not obstructed by the lever 64. The lever 64 is located on the opposite side (the right side) to the leading end portion (the left end portion) of the bed portion 2 with respect to the needle bar 8. When the sewing is performed, the sewing object is placed on the opposite side to the leading end portion of the bed portion 2 with respect to the needle bar 8 less frequently than on the leading end portion side of the bed portion 2. Thus, the user can easily operate the lever 64 in comparison to when the lever 64 is located on the leading end portion (the left end portion) side of the bed portion 2 with respect to the needle bar 8.

The lever 64 is provided below the upper surface of the bed portion 2. Therefore, the sewing machine 1 can avoid the sewing being obstructed by the lever 64. In the sewing machine 1, since the lever 64 can be covered by the cover 9 when the sewing is performed, it is possible to avoid the lever 64 being erroneously operated when the sewing is performed.

The sewing machine 1 is provided with the movement motor 31 as an actuator. Using the driving force of the movement motor 31, the lock release mechanism 17 releases the engagement of the first engagement member 15 and the second engagement member 16. Thus, in the sewing machine 1, with a simple operation of inputting the command to drive the movement motor 31, the user can automatically release the engagement of the first engagement member 15 and the second engagement member 16.

The sewing machine 1 is provided with the feed dog 5 that moves the sewing object, and the feed dog retraction mechanism 14. The feed dog retraction mechanism 14 is coupled to the movement motor 31. Using the movement motor 31 as the drive source, the feed dog retraction mechanism 14 switches the feed dog 5 from the normal position, in which the feed dog 5 can move the sewing object, to the retracted position, in which the feed dog 5 is retracted below the upper surface of the needle plate 11. In this way, using the driving force of the movement motor 31, the sewing machine 1 can drive the feed dog retraction mechanism 14 and switch the feed dog 5 from the normal position to the retracted position. In comparison to when the drive source of the feed dog retraction mechanism 14 and the drive source of the lock release mechanism 17 are separately provided, the configuration of the sewing machine 1 can be made compact.

More specifically, when the feed dog retraction mechanism 14 is coupled to the output shaft 32 of the movement motor 31 and the output shaft 32 reaches the first actuated position shown in FIG. 6B, FIG. 7B and FIG. 8B in which the output shaft 32 has been rotated in the predetermined direction from the reference position shown in FIG. 6A, FIG. 7A and FIG. 8A, the feed dog retraction mechanism 14 switches the feed dog 5 from the normal position to the retracted position. The lock release mechanism 17 is provided with the lever 63 that can rotate the second engagement member 16 in the second direction, and the pressing member 62. As shown in FIG. 4B, FIG. 6C, FIG. 7C and FIG. 8C, the pressing member 62 can press the lever 63 in the second direction when the output shaft 32 reaches the second actuated position in which the output shaft 32 has been rotated further in the predetermined direction than in the first actuated position. Therefore, with a relatively simple configuration, the sewing machine 1 can commonize the drive source of the feed dog retraction mechanism 14 and the drive source of the lock release mechanism 17. In the sewing machine 1, the drive source of the feed dog retraction mechanism 14 and the drive source of the lock release mechanism 17 can be commonized without the engagement of the first engagement member 15 and the second engagement member 16 being released unintentionally when the feed dog 5 is to be moved from the normal position to the retracted position.

The sewing machine of the present disclosure is not limited to the above-described embodiment and various changes may be made without departing from the spirit and scope of the present disclosure. For example, the following modifications may be made as appropriate.

The configuration of the sewing machine 1 may be changed as appropriate. The sewing machine 1 may be an industrial sewing machine or a multi-needle sewing machine. It is sufficient that the first engagement member 15 and the second engagement member 16 are configured such that, when the first engagement member 15 and the second engagement member 16 are engaged with each other, they can fix, in the up-down direction, the needle plate 11 urged upward by the first urging member 67. For example, at least one of the engagement portion 18 and the first convex portion 19 need not necessarily be provided on the first engagement member 15. The second engagement member 16 and the levers 63 and 64 may be separate members. The feed dog 5, the movement motor 31 and the feed dog retraction mechanism 14 may be omitted, if necessary.

The positioning pins 71 and 72 may be omitted if necessary, and the shape, number, arrangement and the like thereof may be changed as appropriate. At least one of the second convex portions 73 and 74 and the cushion materials 75 and 76 need not necessarily be provided on the positioning pins 71 and 72. It is sufficient that the holes 27 and 28 of the needle plate 11 are configured such that the positioning pins 71 and 72 can be inserted therethrough, and the holes 27 and 28 need not necessarily penetrate the needle plate 11 in the up-down direction. The cushion materials 75 and 76 may be provided on the lower surface of the needle plate 11. When the needle plate 11 is fixed to the bed portion 2, the positioning pins 71 and 72 may slightly protrude from the upper surface of the needle plate 11 in a range in which they do not obstruct the sewing.

The arrangement, configuration and the like of the lever 64 that is operated by the user may be changed as appropriate. The lever 64 need not necessarily be capable of being exposed on the upper surface side of the bed portion 2 inside the bed portion 2. For example, inside the bed portion 2, the lever 64 may be able to be exposed on the front surface side or on the left surface side of the bed portion 2. When the lever 64 is able to be exposed on the upper surface side of the bed portion 2, the lever 64 may have a section that is at the same height as the upper surface of the bed portion 2 or a section higher than the upper surface of the bed portion 2. The lever 64 need not necessarily be covered by the cover 9 from above. When the lever 64 is covered by the cover 9 from above, the configuration of the cover 9 may be changed as appropriate. The cover 9 may be attached to the bed portion 2 using a hinge portion. The cover 9 may be movably attached to the bed portion 2 such that the cover 9 can slide in the horizontal direction.

It is sufficient that the lock release mechanism 17 can release the engagement of the first engagement member 15 and the second engagement member 16, and it is sufficient that the lock release mechanism 17 is provided with at least one of the configuration capable of releasing the engagement manually and the configuration capable of releasing the engagement using the driving force of the actuator. In other words, one of the configuration capable of releasing the engagement manually and the configuration capable of releasing the engagement using the driving force of the actuator may be omitted, if necessary. In addition to the step motor, the actuator may be a power cylinder, a solenoid or the like. The actuator to drive the lock release mechanism 17 may be provided separately from the power source of another mechanism, such as the feed dog retraction mechanism 14. The lock release mechanism 17 may be changed as appropriate in accordance with the configuration of the sewing machine 1, the actuator and the like. For example, the movement member 61 and the pressing member 62 may be formed integrally. In the sewing machine 1, the same lever may be moved in the configuration capable of releasing the engagement manually and the configuration capable of releasing the engagement using the driving force of the actuator.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A sewing machine comprising:

a needle plate;

a bed portion configured to support the needle plate;

a first urging member provided inside the bed portion and configured to urge the needle plate upward;

a first engagement member extending downward from a lower surface of the needle plate;

a second engagement member provided inside the bed portion, and configured to fix the needle plate in a fixed position by being engaged with the first engagement member of the needle plate pressed downward against an urging force of the first urging member;

a second urging member configured to urge the second engagement member such that the second engagement member is rotatable in a first direction, the first direction intersecting with an up-down direction;

a pin rotatably fixing the second engagement member; and a lock release mechanism configured to release an engagement of the first engagement member and the second engagement member, the lock release mechanism having a first lever, the first lever being rotatably fixed by the pin, the first lever configured to rotate with the second engagement member around the pin in a second direction opposite to the first direction.

2. The sewing machine according to claim 1, wherein the first engagement member has an engagement portion configured to engage with the second engagement member.

3. The sewing machine according to claim 2, wherein the first engagement member has a first convex portion provided below the engagement portion and protruding further in a horizontal direction than the engagement portion.

4. The sewing machine according to claim 3, wherein when the first engagement member and the second engagement member are engaged with each other, the second engagement member comes into contact with the engagement portion of the first engagement member due to an urging force of the second urging member, and also comes into contact with an upper end of the first convex portion of the first engagement member due to the urging force of the first urging member.

5. The sewing machine according to claim 1, further comprising:

a positioning pin extending upward inside the bed portion, wherein the needle plate includes a hole into which the positioning pin is inserted, and when the first engagement member and the second engagement member are engaged with each other, an upper end of the positioning pin is lower than a height of an upper surface of the needle plate in the fixed position.

6. The sewing machine according to claim 5, wherein the positioning pin includes a second convex portion protruding in a horizontal direction in a position below the needle plate in the fixed position, and a cushion material provided on an upper end of the second convex portion.

7. The sewing machine according to claim 1, wherein the first lever is provided inside the bed portion such that the first lever is able to be exposed on a side of an upper surface of the bed portion.

8. The sewing machine according to claim 7, wherein the first lever is provided below the upper surface of the bed portion.

9. The sewing machine according to claim 8, further comprising:

a cover supported by the bed portion, wherein in a state in which the cover is supported by the bed portion, the cover forms a horizontal plane flush with the upper surface of the bed portion and covers the first lever from above.

10. The sewing machine according to claim 1, further comprising:

an actuator, wherein the lock release mechanism releases the engagement of the first engagement member and the second engagement member using a driving force of the actuator.

11. The sewing machine according to claim 10, further comprising:

a feed dog configured to move a sewing object; and a feed dog retraction mechanism configured to be coupled to the actuator, and to switch the feed dog from a normal position, in which the feed dog is capable of moving the sewing object, to a retracted position, in which the feed dog is retracted below an upper surface of the needle plate, using the actuator as a drive source.

12. The sewing machine according to claim 11, wherein the actuator is a motor having an output shaft, the first engagement member has an engagement portion configured to engage with the second engagement member, and a first convex portion provided below the engagement portion and protruding further in a horizontal direction than the engagement portion, when the first engagement member and the second engagement member are engaged with each other, the second engagement member comes into contact with the engagement portion of the first engagement member due to an urging force of the second urging member, and also comes into contact with an upper end of the first convex portion of the first engagement member due to the urging force of the first urging member, the feed dog retraction mechanism switches the feed dog from the normal position to the retracted position when the feed dog retraction mechanism is coupled to the output shaft and the output shaft reaches a first actuated position in which the output shaft is rotated in a predetermined direction from a reference position, and the lock release mechanism includes a second lever configured to rotate the second engagement member in the second direction, and a pressing member configured to press the second lever in the second direction when the output shaft reaches a second actuated position in which the output shaft is rotated further in the predetermined direction than in the first actuated position.

13. The sewing machine according to claim 1, wherein the first urging member is a plate spring.

* * * * *